US011591172B2

(12) United States Patent
Choi et al.

(10) Patent No.: US 11,591,172 B2
(45) Date of Patent: Feb. 28, 2023

(54) POST-PROCESSING APPARATUS FOR IMAGE FORMING APPARATUS

(71) Applicant: KRDC LTD., Seoul (KR)

(72) Inventors: Yong Suk Choi, Seoul (KR); Yong Hun Choi, Seoul (KR)

(73) Assignee: KRDC LTD.

( * ) Notice: Subject to any disclaimer, the term of this patent is extended or adjusted under 35 U.S.C. 154(b) by 0 days.

(21) Appl. No.: 17/412,249

(22) Filed: Aug. 25, 2021

(65) Prior Publication Data

US 2022/0063936 A1 Mar. 3, 2022

(30) Foreign Application Priority Data

Aug. 25, 2020 (KR) ..... 10-2020-0107285

(51) Int. Cl.
*B65H 1/14* (2006.01)

(52) U.S. Cl.
CPC ..... *B65H 1/14* (2013.01); *B65H 2801/27* (2013.01)

(58) Field of Classification Search
CPC ..... B41J 13/106; B65H 29/20; B65H 29/22; B65H 29/26; B65H 31/02; B65H 2403/51; B65H 2403/514
USPC ..... 271/220; 270/58.11
See application file for complete search history.

(56) References Cited

U.S. PATENT DOCUMENTS

| | | | | |
|---|---|---|---|---|
| 6,209,864 | B1 * | 4/2001 | Taniguchi | B65H 31/34 270/58.11 |
| 7,976,004 | B2 * | 7/2011 | Kimura | B65H 31/3027 270/58.11 |
| 8,684,345 | B2 * | 4/2014 | Matsuo | B42C 1/125 270/58.11 |
| 8,770,582 | B2 * | 7/2014 | Kushida | B65H 31/36 271/306 |
| 9,758,335 | B2 * | 9/2017 | Taki | B65H 29/26 |
| 10,042,305 | B2 * | 8/2018 | Kawaguchi | B65H 31/36 |
| 10,479,636 | B2 * | 11/2019 | Nakano | B65H 43/00 |

(Continued)

*Primary Examiner* — Leslie A Nicholson, III
(74) *Attorney, Agent, or Firm* — Renaissance IP Law Group LLP

(57) ABSTRACT

One embodiment of the present disclosure provides a post-processing apparatus for an image forming apparatus which arranges paper ejected from an ejection part of an image forming apparatus on a fence for post-processing. The post-processing apparatus includes a paddle guide which includes a paddle arm to which a paddle wing is coupled and a pusher positioned adjacent to the ejection part and stands by at a home position until the paper is ejected, a driving part which vertically moves the paddle guide, rotates when the paper is ejected from the ejection part to move the paddle guide downward so that the pusher presses the paper downward and drops the paper on a stacking base, and a paddle wing which vertically moves according to a vertical movement of the paddle guide, moves downward according to a downward movement of the paddle guide, arranges the paper dropped on the stacking base toward the fence positioned adjacent to the stacking base, and then, moves upward with an upward movement of the paddle guide according to operation of the driving part, wherein vertical movements of the pusher and the paddle wing are performed by a vertical movement of the paddle guide performed due to single unit periodic operation of the driving part.

6 Claims, 9 Drawing Sheets

(56) References Cited

U.S. PATENT DOCUMENTS

| | | | | |
|---|---|---|---|---|
| 11,254,145 | B2 * | 2/2022 | Sakagami | B41J 13/106 |
| 11,345,560 | B2 * | 5/2022 | Kondo | B65H 31/10 |
| 11,358,401 | B2 * | 6/2022 | Amano | B65H 31/3027 |
| 11,358,821 | B2 * | 6/2022 | Nakazawa | B65H 29/52 |
| 2009/0218745 | A1 * | 9/2009 | Kushida | B65H 31/3027 270/58.07 |
| 2009/0250861 | A1 * | 10/2009 | Kimura | B65H 31/36 270/58.08 |
| 2017/0183191 | A1 * | 6/2017 | Taki | B65H 31/3027 |
| 2018/0251331 | A1 * | 9/2018 | Nakano | B65H 29/20 |
| 2020/0101768 | A1 * | 4/2020 | Kondo | B65H 43/06 |

* cited by examiner

POST-PROCESSING APPARATUS FOR IMAGE FORMING APPARATUS

CLAIM FOR PRIORITY

This application claims priority to Korean Patent Application No. 10-2020-0107285 filed on Aug. 25, 2020 in the Korean Intellectual Property Office (KIPO), the entire contents of which are hereby incorporated by reference.

BACKGROUND

1. Technical Field

Example embodiments of the present disclosure relate to a post-processing apparatus for an image forming apparatus, and more specifically, to a post-processing apparatus for an image forming apparatus for paper arrangement required for post-processing such as paper arrangement, punching, or stapling of an image forming apparatus such as a printer or copier.

2. Related Art

Image forming apparatuses, which form letters or pictures on paper, generally include printers, copiers, scanners, fax machines, or multifunction devices including one or more thereof. Image forming apparatuses form letters or pictures on one surface or both surfaces of a sheet while automatically feeding sheets having various sizes. There are many cases in which post-processing apparatuses referred to as "finishers" are additionally applied to the image forming apparatuses such as copiers, fax machines, scanners, and printers.

FIG. 1 is a view illustrating an example of the image forming apparatus and the post-processing apparatus.

In FIG. 1, a paper relay apparatus 20 may be provided between an image forming apparatus 10 and a post-processing module 30. The image forming apparatus forms a picture (for example, a text or image) on supplied paper. The paper on which the picture is formed may pass through the paper relay apparatus through a paper transfer path, may be ejected by an ejection roller 31, may fall downward by a post-processing apparatus 100, and may be arranged on a fence 32. A bookbinding operation, such as stapling, may be performed on sheets of the paper arranged on the fence.

The bookbinding operation may be performed when the number of the sheets of the ejected paper arranged on the fence 32 becomes a specific number. That is, when the sheets of the paper consecutively fall downward from the post-processing apparatus 100 and the specific number of the sheets of the paper are arranged on the fence 32 connected to a stacking base 33, the bookbinding operation of stapling the corresponding number of the sheets of the paper may be performed. That is, the post-processing apparatus performs an operation of repeatedly dropping the paper ejected from the ejection roller and arranging the paper.

In a case in which the paper ejected from the ejection roller freely falls downward, it may take a considerable time to fall to a stacking base 33. In addition, since the paper may fall downward while shaking in a lateral direction in the air, there may be problems in that the several sheets of paper fall on the stacking base 33 in a staggered fashion or fall on a portion outside the stacking base 33. Particularly, the sheets of the paper may be consecutively transferred from the paper relay apparatus 20 at high speed, in this case, when the paper freely falls downward as described above, it may be very difficult to arrange the sheets of the paper.

Accordingly, as described above, it is necessary for the post-processing apparatus to force the ejected paper downward to drop the paper onto the stacking base and arrange the paper on the fence. However, in the case in which the paper is ejected at high speed as described above, the post-processing apparatus needs to perform the drop and arrangement operations in a quick and highly reliable manner.

That is, among the efficiency of a total system including the image forming apparatus and the post-processing apparatus, the efficiency and reliability of the paper free-fall and the paper arrangement operation of the post-processing apparatus are important. That is, it is necessary for the post-processing apparatus to be efficiently operated so that an operation time thereof is not unnecessarily increased or the post-processing apparatus does not perform an overly complicated operation.

SUMMARY

Accordingly, example embodiments of the present disclosure are provided to substantially obviate one or more problems due to limitations and disadvantages of the related art.

Example embodiments of the present disclosure provide a post-processing apparatus for an image forming apparatus which performs paper arrangement required for post-processing such as stapling paper ejected from an image forming apparatus and in which an efficient and simple operation is performed.

However, objectives to be solved by the present disclosure are not limited to the above-described objectives, and other objectives which are not described above will be clearly understood by those skilled in the art through the following specification.

In some example embodiments, a post-processing apparatus for an image forming apparatus, which arranges paper ejected from an ejection part of an image forming apparatus on a fence for post-processing, is provided. The post-processing apparatus includes a paddle guide which includes a paddle arm to which a paddle wing is coupled and a pusher positioned adjacent to the ejection part and stands by at a home position until the paper is ejected, a driving part which vertically moves the paddle guide, rotates when the paper is ejected from the ejection part to move the paddle guide downward so that the pusher presses the paper downward and drops the paper on a stacking base, and a paddle wing which vertically moves according to a vertical movement of the paddle guide, moves downward according to a downward movement of the paddle guide, arranges the paper dropped on the stacking base toward the fence positioned adjacent to the stacking base, and then, moves upward with an upward movement of the paddle guide according to operation of the driving part, wherein vertical movements of the pusher and the paddle wing are performed by a vertical movement of the paddle guide performed due to single unit periodic operation of the driving part.

The paddle arm and the pusher may be integrally formed.

The driving part may vertically move the pusher and the paddle wing by vertically moving the paddle guide.

The paddle guide may stand by at a home position until a rear end of the paper passes through the ejection part, and the driving part may rotate to move the paddle guide downward after a preset first time point after the rear end of the paper passes through the ejection part. The paddle wing may rotate after a preset second time point after the paddle wing moves downward according to the operation of the driving part, come into contact with the paper, arrange the paper toward the fence, and then, move upward with the upward movement of the paddle guide according to the operation of the driving part.

The paddle guide may be rotatably coupled to another portion of the post-processing apparatus.

The paddle guide may include a first end portion on which the pusher is provided, a second end portion which is coupled to the another portion by a support shaft, and a third end portion to which the paddle wing is rotatably coupled.

BRIEF DESCRIPTION OF DRAWINGS

Example embodiments of the present disclosure will become more apparent by describing example embodiments of the present disclosure in detail with reference to the accompanying drawings, in which.

DESCRIPTION OF EXAMPLE EMBODIMENTS

Since the present disclosure allows for various changes and numerous embodiments, specific embodiments will be illustrated in the accompanying drawings and given in the detailed description. However, this is not intended to limit the present disclosure to the specific embodiments, and it is to be appreciated that all changes, equivalents, and substitutes that do not depart from the spirit and technical scope of the present disclosure are encompassed in the present disclosure. Like numbers refer to like elements throughout the description of the figures.

Unless otherwise defined, all terms (including technical and scientific terms) used herein are to be interpreted as is customary in the art to which this disclosure belongs. It should be further understood that terms in common usage should also be interpreted as is customary in the relevant art and not in an idealized or overly formal sense unless expressly so defined herein.

Hereinafter, exemplary embodiments of the disclosure will be described in detail with reference to the accompanying drawings.

Figure 1:
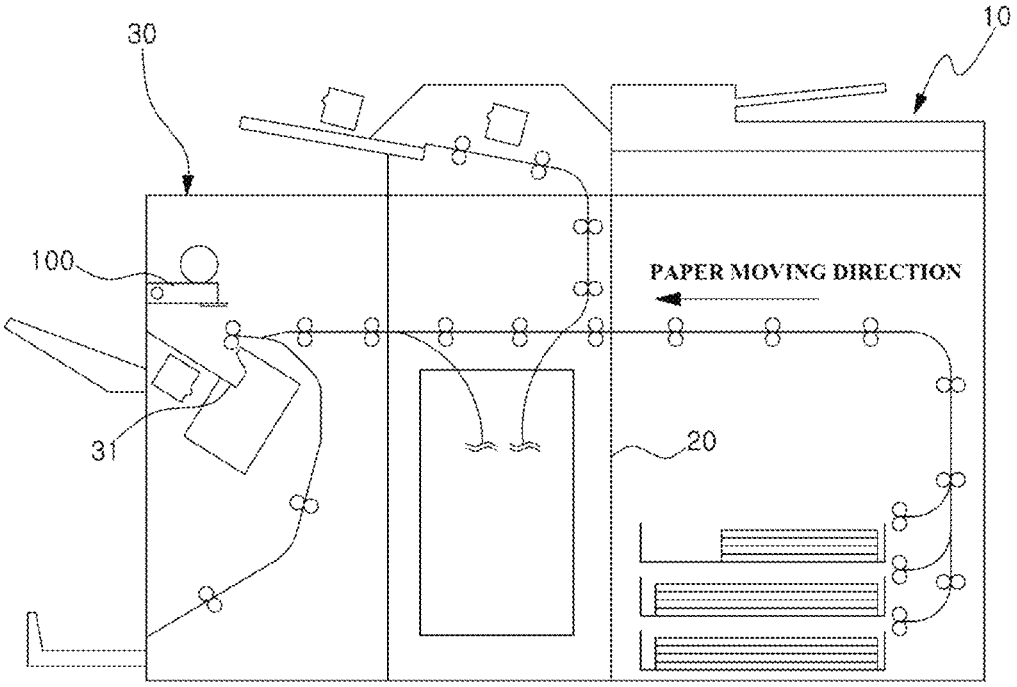
FIG. 1 is a view illustrating an example in which a post-processing apparatus for an image forming apparatus according to one embodiment of the present disclosure is installed.
Figure 2:
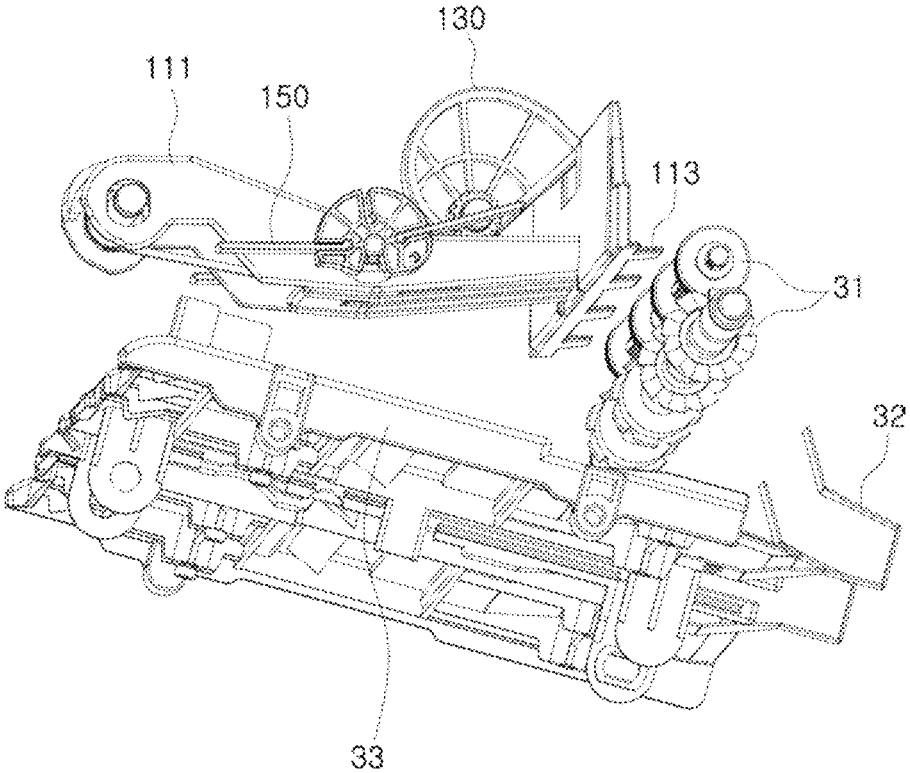
FIG. 2 is a view illustrating the post-processing apparatus for an image forming apparatus according to one embodiment of the present disclosure.

FIG. 2 is a view illustrating a post-processing apparatus for an image forming apparatus according to one embodiment of the present disclosure.

A post-processing apparatus 100 for an image forming apparatus (hereinafter, referred to as a post-processing apparatus) may arrange paper 70 ejected from an ejection part (for example, an ejection roller 31) of an image forming apparatus 10 on a fence 32 for performing post-processing. In this case, the post-process may include post-processing operation including stapling of sheets of the paper 70 arranged on the fence 32.

The post-processing apparatus 100 includes a paddle guide 110, a driving part 130, and a paddle wing 150.

The paddle guide 110 may include a paddle arm 111 and a pusher 113 positioned adjacent to the ejection roller 31.

Hereinafter, components will be described with an operation of the post-processing apparatus.

Figure 3:
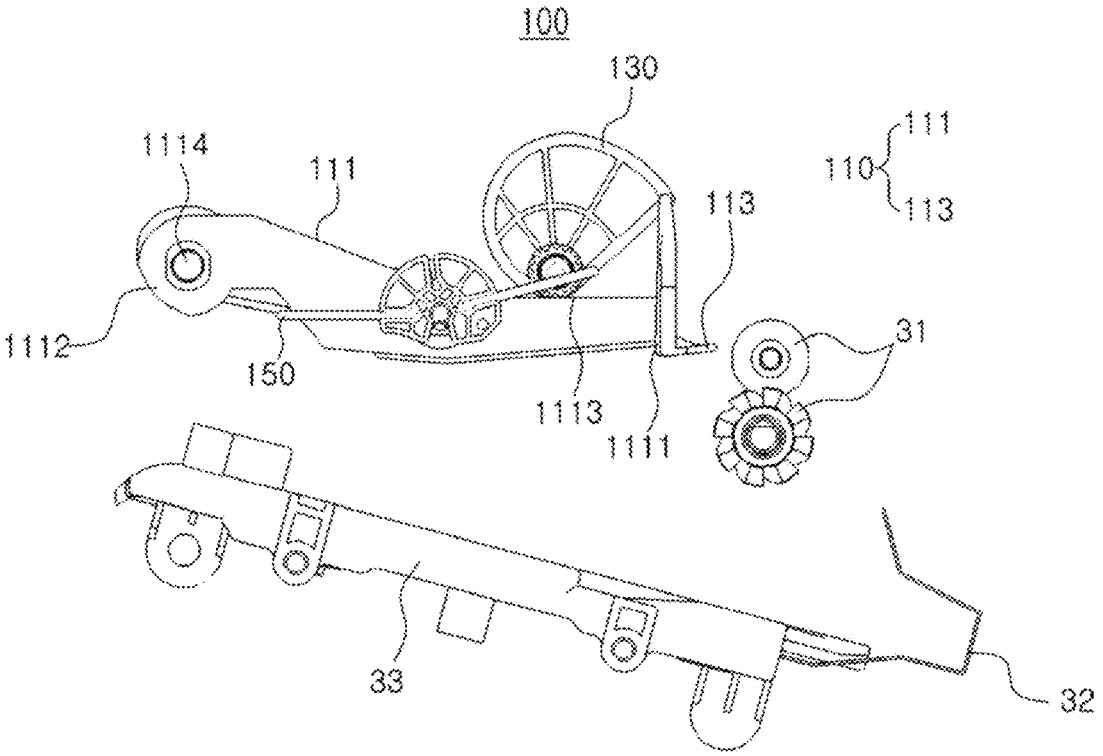
FIGS. 3 and 4 are views for describing a stand-by state of the post-processing apparatus for an image forming apparatus according to one embodiment of the present disclosure.
Figure 4:
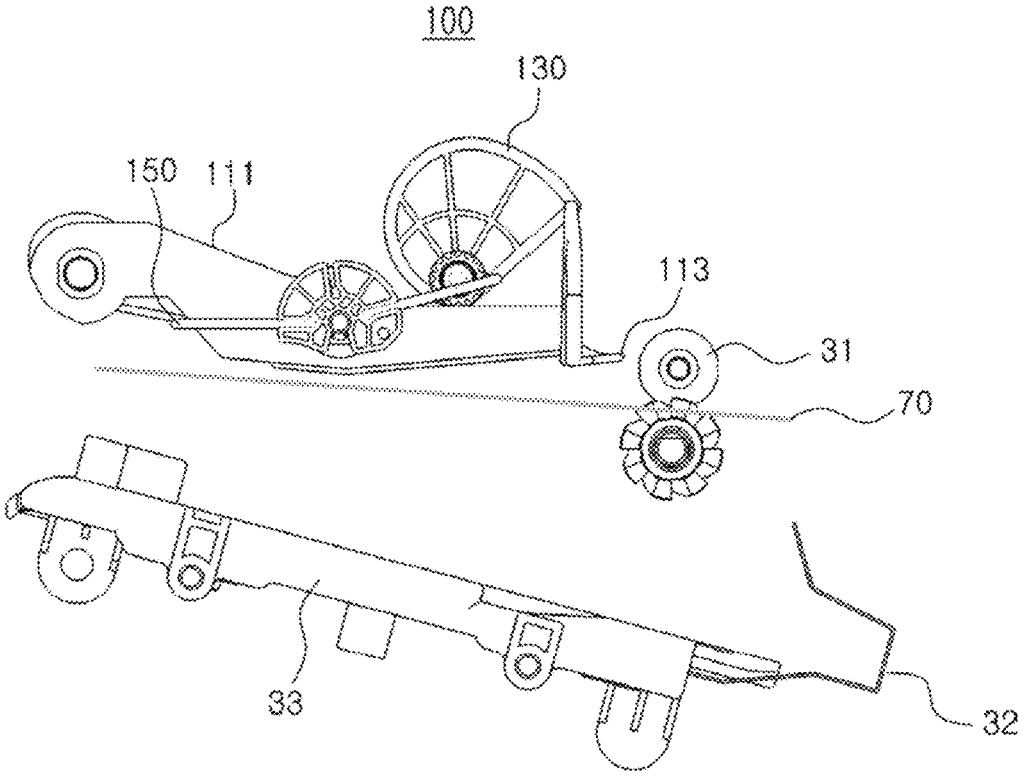

FIGS. 3 and 4 are views for describing a stand-by state of the post-processing apparatus for an image forming apparatus according to one embodiment of the present disclosure.

As illustrated in FIGS. 2 and 3, the paddle guide 110 may stand by at a home position until the paper 70 is ejected from the ejection roller 31.

The paddle arm 111 may be integrally formed with the pusher 113. The paddle guide 110 may be rotatably coupled to another portion of the post-processing apparatus 100.

For example, the paddle guide 110 may include a first end portion 1111 on which the pusher 113 is provided, a second end portion 1112 coupled to another portion of the post-processing apparatus 100 by a support shaft 170, and a third end portion to which the paddle wing is coupled.

When the driving part 130 comes into contact with an operation surface 1113 and performs a single unit periodic operation, the paddle guide 110 may rotate about the support shaft 170, the first end portion 1111 may move downward and return to an original position according to an operation of the support shaft 170 or the driving part. In this case, the single unit periodic operation may include a rotating motion, a reciprocating motion, or the like of the driving part. This will be further described below.

Figure 5:
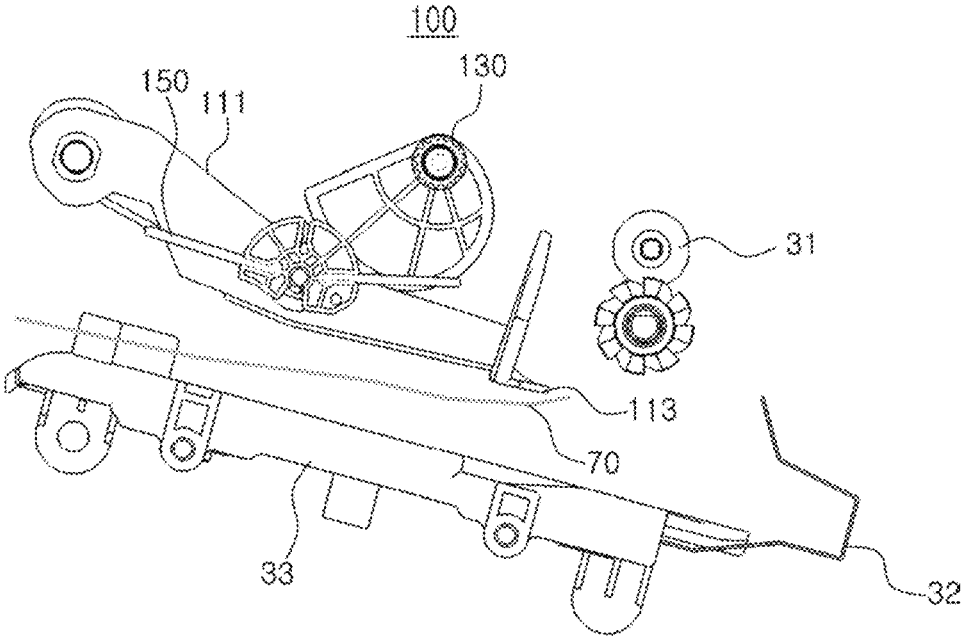
FIG. 5 is a view for describing an operation in which a pusher drops paper as a paddle guide moves downward according to an operation of a driving part of the post-processing apparatus for an image forming apparatus according to one embodiment of the present disclosure.

FIG. 5 is a view for describing an operation in which the pusher 113 drops the paper 70 according to rotation of the driving part of the post-processing apparatus for an image forming apparatus according to one embodiment of the present disclosure.

The paddle guide 110 may be stand by at the home position until a rear end of the paper 70 passes through the ejection part (see FIG. 4), and the driving part 130 may rotate to move the paddle guide 110 downward (see FIG. 5) after a preset first time point after the rear end of the paper 70 passes through the ejection part.

The driving part 130 may be positioned at an upper side of the operation surface 1113 of the paddle guide 110. The driving part 130 may include, for example, a rotating body, and the rotating body may rotate while being in contact with the operation surface 1113 so that a vertical motion of the paddle guide 110 may be performed by a single rotating operation of the rotating body.

A control part rotates the driving part 130 to move the paddle guide 110 downward when the paper 70 is ejected from the ejection roller 31, and thus the pusher 113 positioned above the paper 70 moves downward to press the paper 70 downward so as to drop the paper 70 toward a stacking base 33.

That is, as illustrated in FIG. 5, since the paddle guide is moved downward by the rotation of the driving part 130, the pusher 113, which is moved downward according thereto, may drop the paper 70 onto the stacking base 33 inclined in a direction from the second end portion 1112 toward the first end portion 1111.

Figure 6:
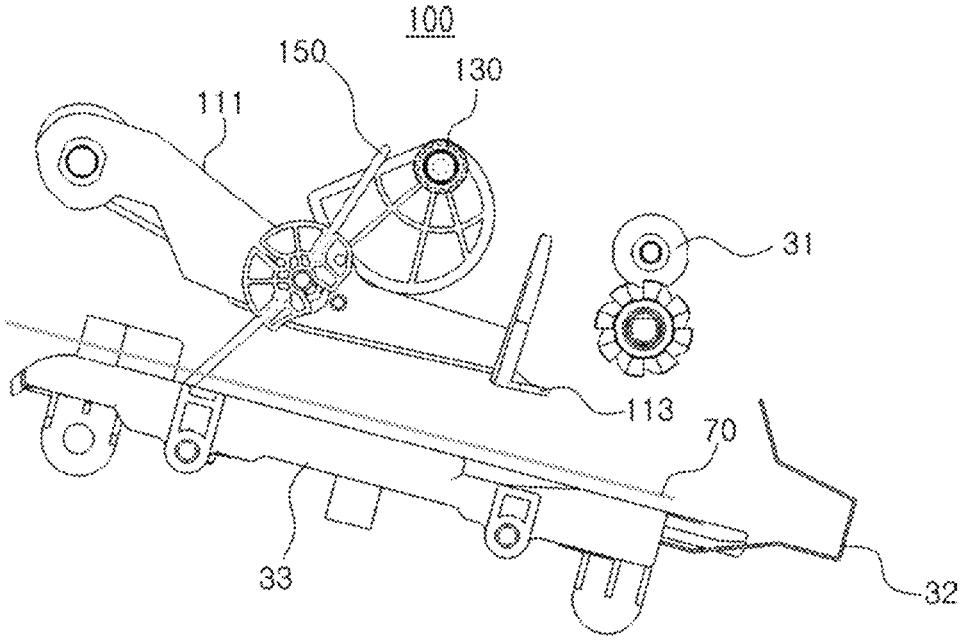
FIG. 6 is a view for describing an operation in which a paddle wing of the post-processing apparatus for an image forming apparatus according to one embodiment of the present disclosure arranges the paper.

FIG. 6 is a view for describing an operation in which the paddle wing 150 of the post-processing apparatus for an image forming apparatus according to one embodiment of the present disclosure arranges the paper 70.

The paddle wing 150 may be installed on a side surface of the paddle arm 111, and the driving part 130 may be positioned at an upper side of the paddle arm 111. The paddle wing 150 may be rotatably coupled to the paddle arm 111. The paddle wing 150 may be coupled to a rotary shaft 151 installed on the paddle arm 111 and further include a driving belt 171 which connects the support shaft 170 and the rotary shaft 151.

The paddle guide 110 vertically moves according to the rotation of the driving part 130, and accordingly, the pusher and the paddle wing 150 may be vertically moved with the paddle guide 110 by the singe periodic operation, for example, a single rotation operation or reciprocating operation, of the driving part.

After the paddle wing 150 moves downward according to a downward movement of the paddle guide 110, the paddle wing 150 may arrange the paper 70 having fallen on the stacking base 33 toward the fence 32 positioned adjacent to the stacking base 33.

For example, after the paddle guide 110 moves downward, the paddle wing 150 may rotate to come into contact with the paper 70 after a preset second time point, and the paper 70 may be arranged toward the fence 32 by friction with the paddle wing 150. Rotation of the paddle wing 150 may be performed as power is transmitted by the above-described driving belt 171 (see FIG. 4). In addition, a rotation mechanism of the paddle wing may be variously changed.

Figure 7:
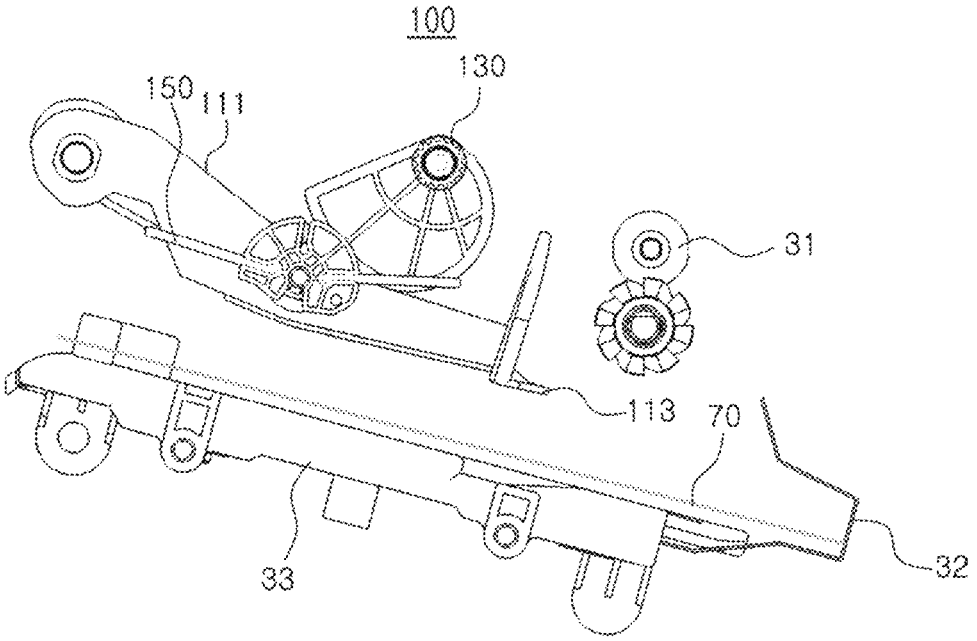
FIGS. 7 and 8 are views for describing an operation in which the paddle guide is moved upward and returned to an original position according to the operation of the driving part of the post-processing apparatus for an image forming apparatus according to one embodiment of the present disclosure.
Figure 8:
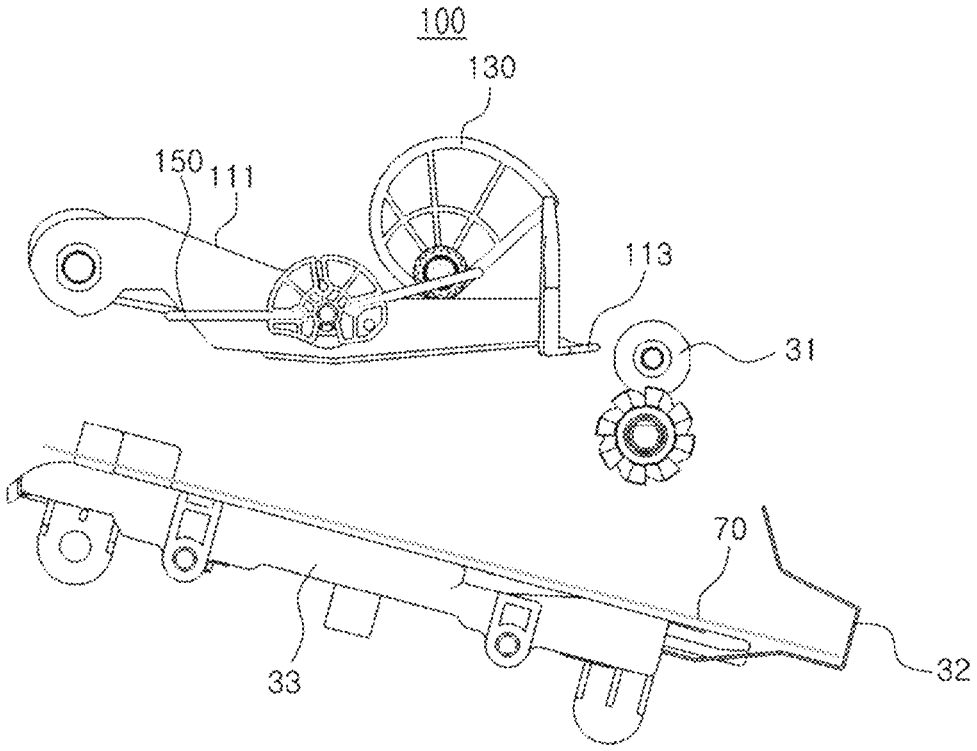

FIGS. 7 and 8 are views for describing an operation in which the paddle guide 110 is moved upward and returned to the original position according to the operation of the driving part of the post-processing apparatus for an image forming apparatus according to one embodiment of the present disclosure.

Thereafter, the paddle wing 150 moves upward together with an upward movement of the paddle guide 110, and the paddle guide 110 returns to the home position which is the original position thereof. Then, in a case in which another piece of paper 70 is ejected from the ejection part of the image forming apparatus 10, the above-described operation may be repeated. That is, due to a single operation period, for example, the single rotation operation, of the driving part, a downward movement of the pusher and downward movement of the paddle wing according to a movement of the paddle guide are performed together so that the desired operations are performed, and then, an upward movement of the pusher and an upward movement of the paddle wing may be performed, and the operation of returning to the original position may be performed.

The timings and time intervals of the operations may be easily adjusted by adjusting the first time point and the second time point.

The driving part 130 may include a cam as an example of the rotating body. A vertical movement of the pusher 113 and the paddle wing 150 are performed through a vertical movement of the paddle guide 110 performed by the rotation of the driving part 130.

That is, as the paddle guide 110 is moved downward by the single rotation operation of the driving part, the pusher is integrally formed with the paddle guide, the paddle arm, to which the paddle wing may be coupled, is coupled to the paddle guide, a paper pressing operation of the pusher 113 and the downward movement of the paddle wing for paper arrangement are performed together, and all operations of returning to the original position are performed. Accordingly, a structure is simple so that a small number of the components are required, and an operation time is reduced.

Meanwhile, like a comparative example, which will be described below, in a case in which a driving part for an operation of a pusher 320 and a driving part for an operation of a paddle arm to which a paddle wing 150 may be coupled are individually provided, that is, two driving parts are provided and operated, there are problems in that the number of components increases, a probability of failure increases, control is inconvenient, and the time required for stopping and operating the driving units increases.

According to the post-processing apparatus 100 of the present embodiment, the problems of the comparative example can be overcome.

FIGS. 9 to 13 are views for describing an operation of a post-processing apparatus for an image forming apparatus according to the comparative example.

In a post-processing apparatus of the comparative example, a pusher cam 330 for operation of the pusher 320 and a paddle arm cam 340 for a vertical movement of a paddle arm 350 are operated separately.

Figure 9:
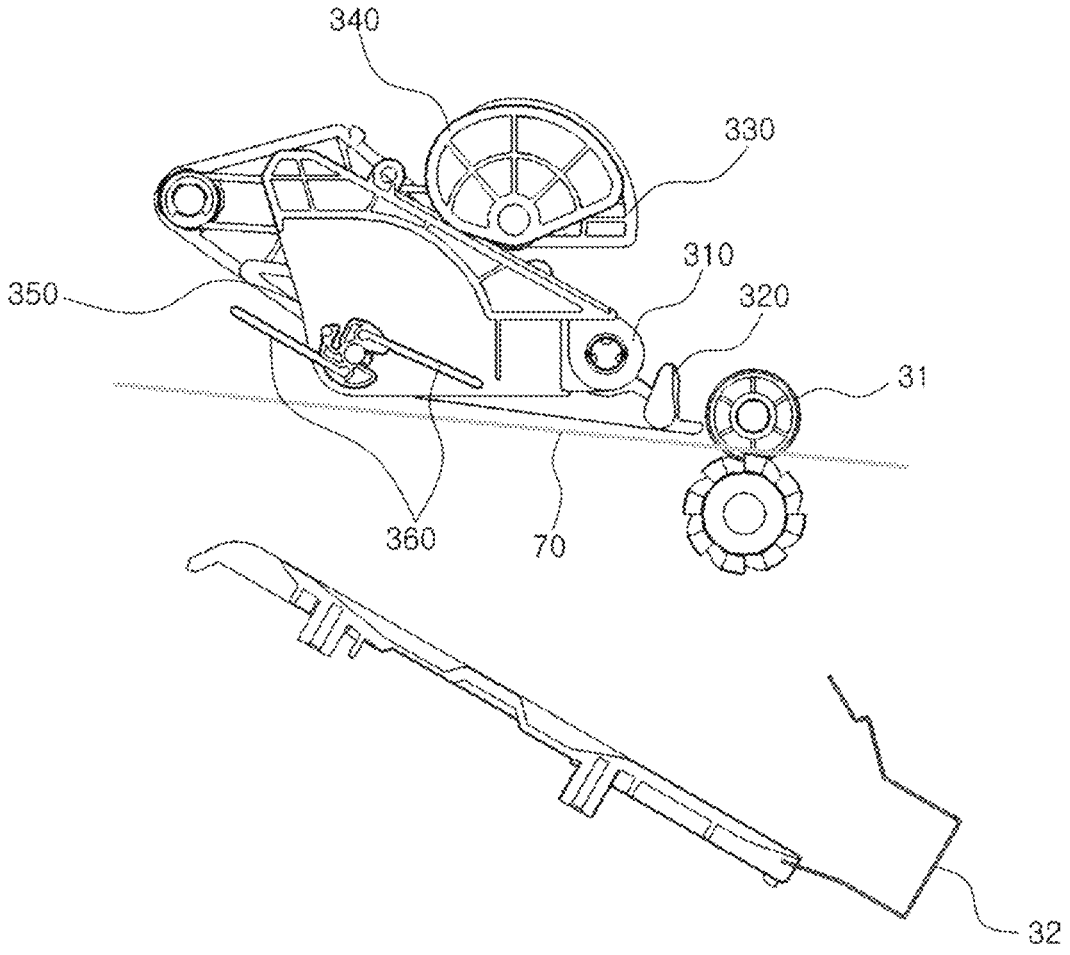
FIGS. 9 to 13 are views for describing an operation of a post-processing apparatus for an image forming apparatus according to a comparative example.

In FIG. 9, while paper 70 is ejected from an ejection roller 31 of an image forming apparatus 10, until a rear end of the paper 70 passes through the ejection roller 31, the paddle arm 350 and the pusher 320 are positioned at a home position.

Figure 10:
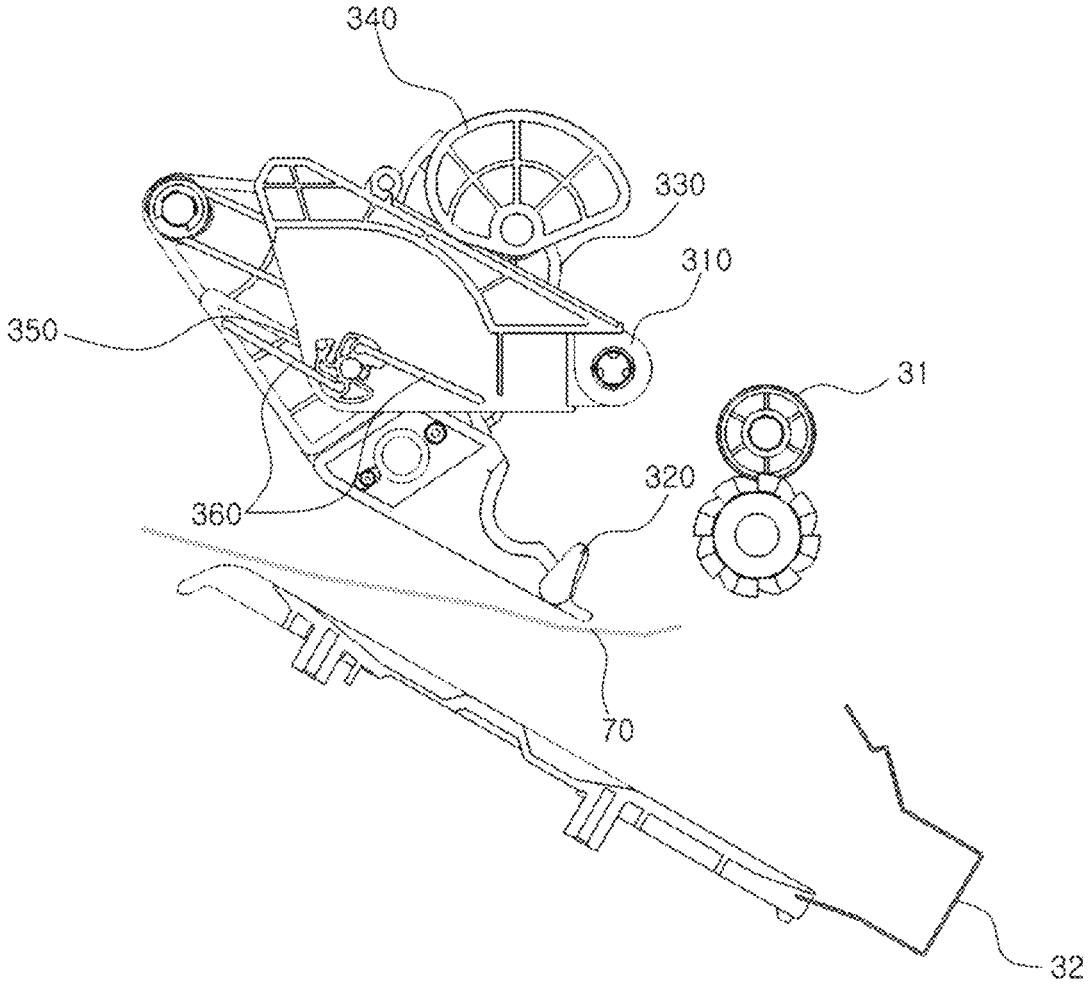

In FIG. 10, at a preset time point after the rear of the paper 70 passes through the ejection roller 31, while the pusher 320 is moved downward by rotation of the pusher cam 330, the pusher 320 presses the paper 70 to drop the paper 70 toward the stacking base 33.

Figure 11:
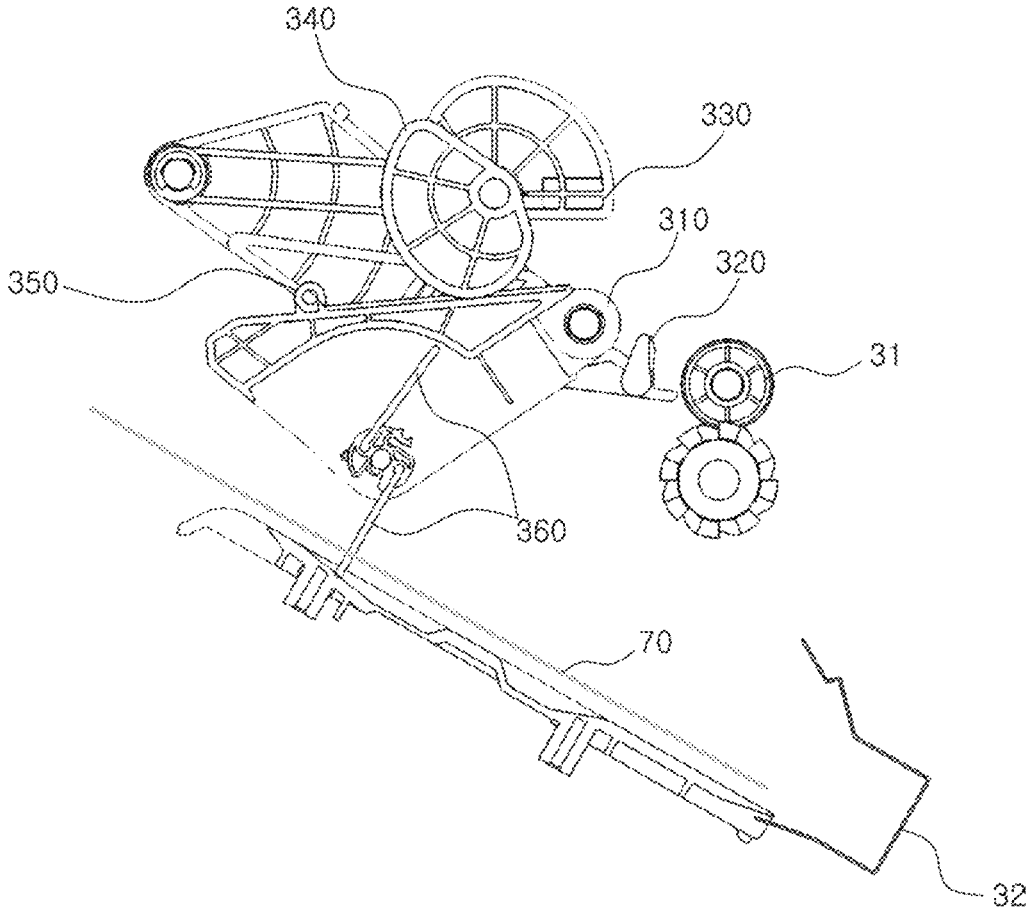

In FIG. 11, at a preset time point after the pusher 320 moves downward, the pusher 320 is moved upward and returned to the home position again by the rotation of the pusher cam 330. In addition, at a predetermined time point, the paddle arm 350 is moved downward by rotation of the paddle arm cam 340, and then, at a predetermined time point, a paddle wing 360 coupled to the paddle arm 350 rotates. When the paddle wing 360 rotates, the paddle wing 360 comes into contact with the paper 70 and arranges the paper 70 toward a fence 32.

Figure 12:
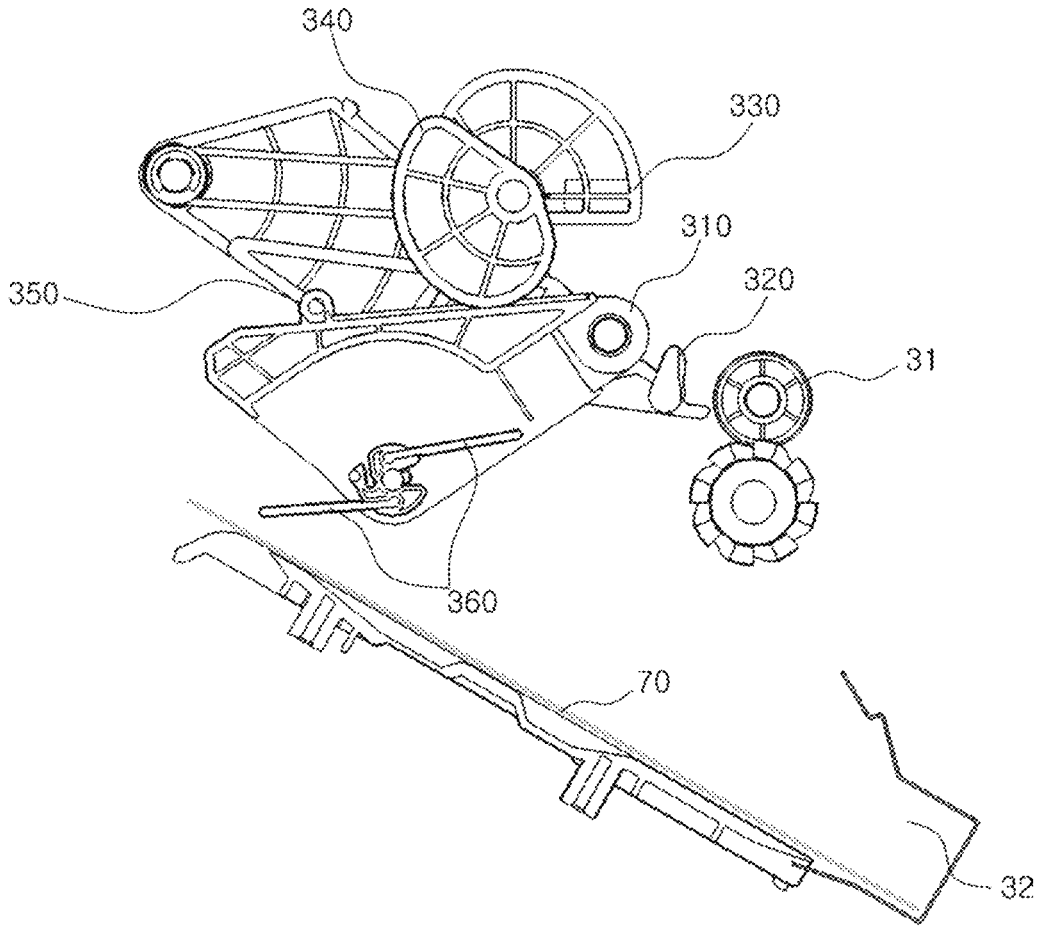
Figure 13:
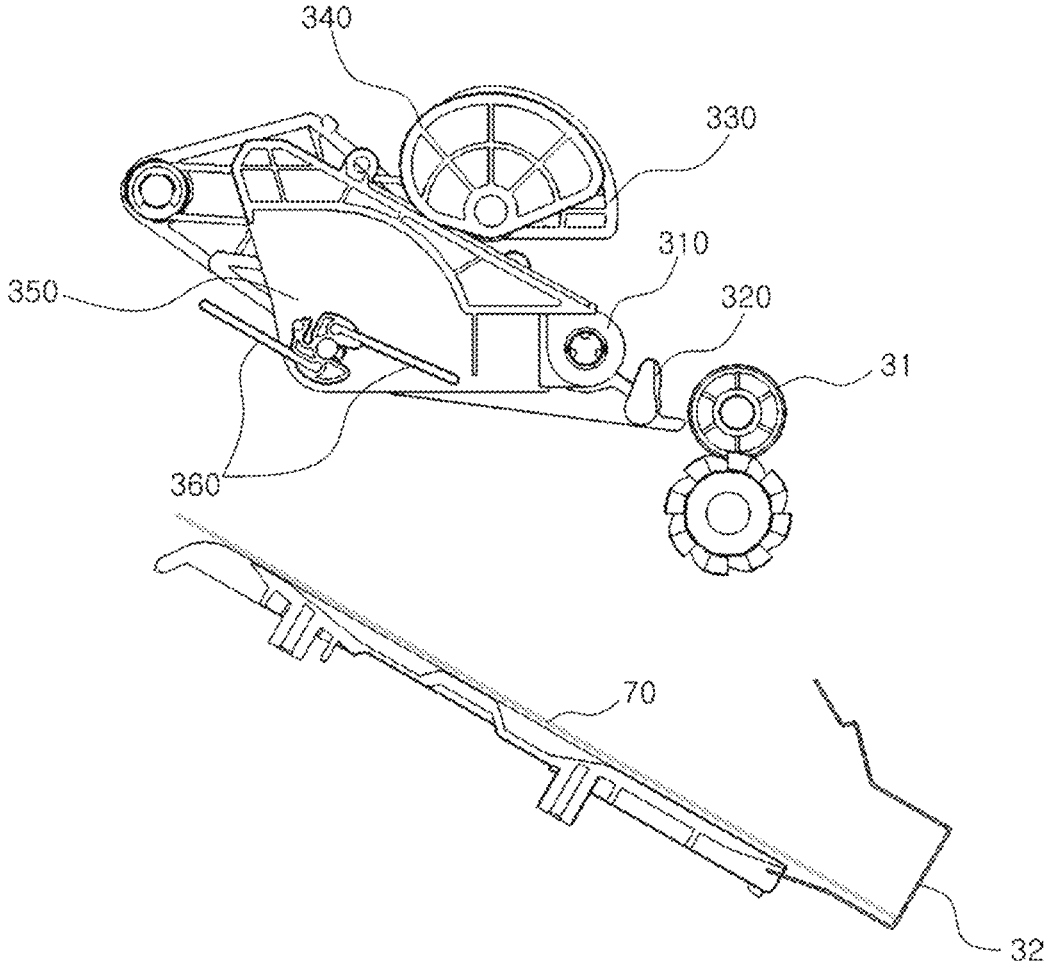

In FIG. 12, when the paper 70 reaches the fence 32 after the paddle wing 360 rotates, at a predetermined time point, the paddle arm cam 340 rotates again, the paddle arm 350 moves upward, and as illustrated in FIG. 13, the paddle arm 350 returns to an original position.

That is, in the post-processing apparatus of the comparative example, it takes time to operate and stop the pusher cam 330 and operate and stop the paddle arm cam 340, an upward movement of the pusher 320 and an upward movement of the paddle arm 350 are performed separately, timings thereof should be controlled separately, and the number of components increases.

On the other hand, according to the post-processing apparatus 100 according to the embodiment of the present disclosure described in FIGS. 1 to 8, the pusher is coupled to or integrally formed with the paddle guide, and the paddle arm to which the paddle wing may be coupled is coupled to the paddle guide. As the paddle guide is moved downward by a single rotation of the driving part 130, vertical movements of the pusher 113 and the paddle wing 150 are performed, and since only the single rotation of the driving part is controlled, control is easy and accurate, the number of the components is reduced, and thus a risk of failure can be reduced and manufacturing costs can be reduced.

According to the embodiment of the present disclosure, as paper arrangement required for post-processing such as stapling of paper ejected from an image forming apparatus is performed, and vertical movements of a pusher and a paddle wing are performed through a vertical movement of a paddle guide performed by a single operation of a driving part, components are simplified, and control is easy so that a post-processing apparatus for an image forming apparatus suitable for a high-speed operation can be provided when compared to a case in which a vertical movement of a pusher and a vertical movement of a paddle wing are controlled individually.

What is claimed is:

1. A post-processing apparatus for an image forming apparatus, which arranges paper ejected from an ejection part of an image forming apparatus on a fence for performing post-processing, the post-processing apparatus comprising:

a paddle guide which includes a paddle arm to which a paddle wing is coupled and is rotatable about a support shaft, and a pusher positioned adjacent to the ejection part and is configured to stand by at a home position until the paper is ejected; and a driving part which is configured to vertically move the paddle guide, rotate when the paper is ejected from the ejection part to move the paddle guide downward so that the pusher presses the paper downward and drop the paper on a stacking base, wherein the paddle wing is configured to vertically move according to a vertical movement of the paddle guide, move downward according to a downward movement of the paddle guide, arrange the paper dropped on the stacking base toward the fence positioned adjacent to the stacking base, and then move upward with an upward movement of the paddle guide according to operation of the driving part, wherein the paddle arm and the pusher are integrally formed and the paddle wing is installed on a side surface of the paddle arm, wherein the paddle guide is inclined in a direction from the support shaft toward the pusher by rotation of the driving part so that the pusher and the paddle wing are downwardly moveable, and wherein vertical movements of the pusher and the paddle wing are performed by a vertical movement of the paddle guide performed due to single unit periodic operation of the driving part.

2. The post-processing apparatus of claim 1, wherein:

the driving part includes a rotating body which is configured to act on the paddle guide; and the paddle guide is vertically moveable by a single rotation, which is the single unit periodic operation, of the rotating body, to vertically move the pusher and the paddle wing.

3. The post-processing apparatus of claim 1, wherein:

the paddle guide is configured to stand by at a home position until a rear end of the paper passes through the ejection part; and the driving part is configured to rotate to move the paddle guide downward after a preset first time point after the rear end of the paper passes through the ejection part.

4. The post-processing apparatus of claim 3, wherein the paddle wing is configured to rotate after a preset second time point after the paddle guide moves downward according to the operation of the driving part, come into contact with the paper, arrange the paper toward the fence, and then move upward with the upward movement of the paddle guide according to the operation of the driving part.

5. The post-processing apparatus of claim 1, wherein the paddle guide is rotatably coupled to another portion of the post-processing apparatus.

6. The post-processing apparatus of claim 5, wherein the paddle guide includes:

a first end portion on which the pusher is provided;

a second end portion which is coupled to the another portion by a support shaft; and a third end portion to which the paddle wing is rotatably coupled.

* * * * *